United States Patent [19]

Crowle et al.

[11] 4,011,970

[45] Mar. 15, 1977

[54] SAFETY ACTUATOR CAP

[75] Inventors: William G. Crowle, Deerfield; Efrem M. Ostrowsky, Highland Park, both of Ill.

[73] Assignee: VCA Corporation, Baton Rouge, La.

[22] Filed: May 20, 1976

[21] Appl. No.: 688,229

[52] U.S. Cl. ..... 222/321; 222/402.13

[51] Int. Cl.[2] ..... B65D 83/14

[58] Field of Search ..... 222/402.13, 402.11, 222/402.14, 320, 321; 200/42 R

[56] References Cited

UNITED STATES PATENTS 3,323,690 6/1967 Monahon ..... 222/402.13

*Primary Examiner*—Stanley H. Tollberg
*Assistant Examiner*—Hadd Lane
*Attorney, Agent, or Firm*—Donald L. Johnson; John F. Sieberth; Edgar E. Spielman, Jr.

[57] ABSTRACT

An overcap for use on dispensing containers which cap offers resistance to attempts by a child to dispense the contents from the container is disclosed. The overcap features an actuator mounted on the container dispensing stem, an outer shell which encloses the actuator and a U-shaped communicator which movably contacts, at its bottom end, the actuator and which has a portion of each vertical leg protruding through apertures in the outer shell. Pressing downward on both of the protruding legs simultaneously will depress the actuator and cause the contents of the container to be dispensed. Application of downward pressure on only one of the protruding legs will not result in depression of the actuator but rather only partial rotation of the communicator on the top of the actuator.

13 Claims, 17 Drawing Figures

SAFETY ACTUATOR CAP

BACKGROUND OF THE INVENTION

Dispensing containers of the hand-held variety, e.g. aerosol or spray pump types are used quite commonly for packaging and dispensing a multiplicity of products. Many of the products dispensed could cause harm to uninformed users such as children. Products dispensed may include paint, lacquers, oil, hair spray, insecticides, cleansers, paint removers, oven cleaners, etc. Obviously, due to the hazardousness of such materials, unauthorized utilization of such should be prevented.

Fortunately there are many so-called "child-resistant" devices presently on the market to prevent dispensing of harmful products by children. However, most of these devices rely upon either the difference in strength or manual coordination between an adult and a child. Such reliance oftentimes results in frustration for adults who do not have the strength or manual dexterity even though they have the mental maturity to effect dispensing of the products. This is especially true of persons suffering from arthritis, etc. Thus there is a need for a child-resistant actuator cap which may be utilized on dispensing containers which does not rely on any difference of strength or manual coordination between an adult and a child.

It is, therefore, an object of this invention to provide a child-resistant device which may be utilized on dispensing containers which is highly child-resistant but which at the same time is easily usable by adults —indeed the actuator of this invention is particularly suitable for use even by adults suffering from physical disabilities of the hands.

THE INVENTION

This invention relates to a safety overcap for use on dispensing containers which have a stem extending from the top of the container, which stem, when depressed, results in product being dispensed. The overcap features: an actuator which fits on to the stem; an outer shell attached to the container and enclosing the actuator; and a U-shaped communicator contacting the actuator at the communicator's bottom portion and having a portion of its legs extending through apertures in the outer shell. The overcap also has attaching structure for attaching it to the container. A dispensing window is provided in the overcap through which the product will be dispensed.

A preferred method for attaching the overcap to aerosol containers is achieved by the use of snap type attachment. The snap attachment is provided by a snap fit between an undercut shoulder in the mounting of the container and by a series of inwardly projecting protuberances carried by a cylindrical element which is mounted on the inside of the outer shell.

Since most containers are cylindrical in configuration, it is also preferred that the outer shell also have a cylindrical shape to provide an aesthetically pleasing package.

It is also preferable for the cylindrical element to carry guidance structure which will help guide the actuator so that it will not have a tendency to wobble as it moves along its upward and downward path. Preference is also given to actuators which feature an arcuate recess which receives the curved bottom portion of the U-shaped communicator. Such an arcuate recess aids in preventing the communicator from sliding off of the actuator.

By utilizing the U-shaped communicator in conjunction with the actuator covering outer shell, the average child will have difficulty in dispensing the contents from the container. Due to the shape of the communicator the child will have to simultaneously depress both legs of the communicator to depress the actuator for release of the container contents. A small child mimicking an adult depressing the single button of conventional aerosol or spray pump dispensers would only depress one of the communicator legs. By depressing one of the communicator legs, dispensing of the contents will not occur as the communicator will simply partially rotate on top of the actuator and not depress it. Not having the mental maturity of an adult, a child will have great difficulty in mentally solving the problem of dispensing the contents of the container. At the same time, the enfeebled and arthritic adult will be able to easily depress both legs of the communicator and achieve dispensing of the container contents. Thus the overcap of this invention solves the age-old problem of providing a safety dispensing device which depends upon only the difference in mental maturity between an adult and a child and not upon any differences in physical dexterity or physical strength.

These and other features contributing satisfaction in use and economy in manufacture will be more fully understood from the following description of preferred embodiments of the invention when taken in connection with the accompanying drawings wherein identical numerals refer to identical parts and in which.

Figure 1:
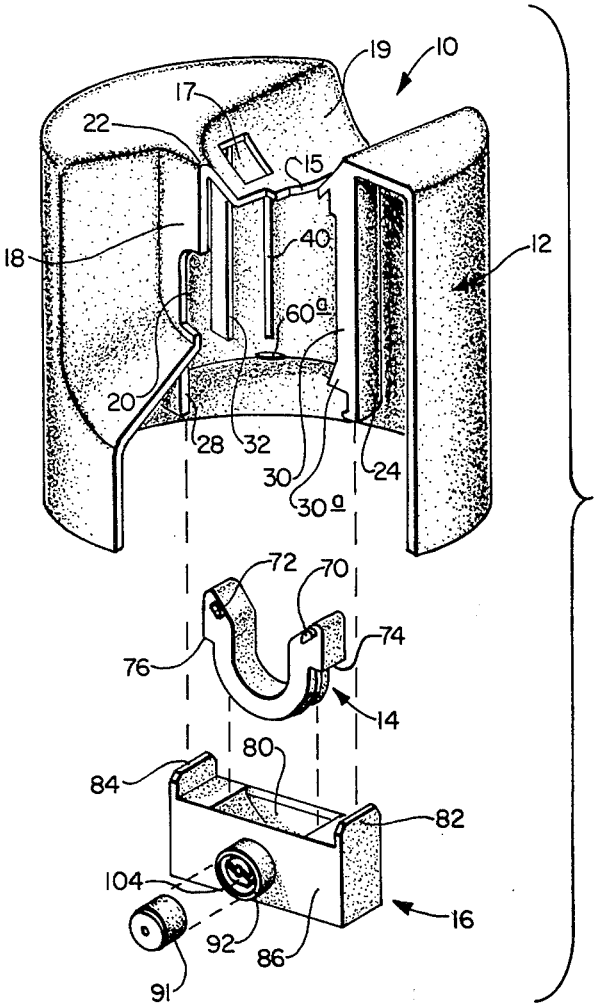
FIG. 1 is a perspective, exploded, partially broken view of an overcap of this invention adapted for use on an aerosol container.
Figure 2:
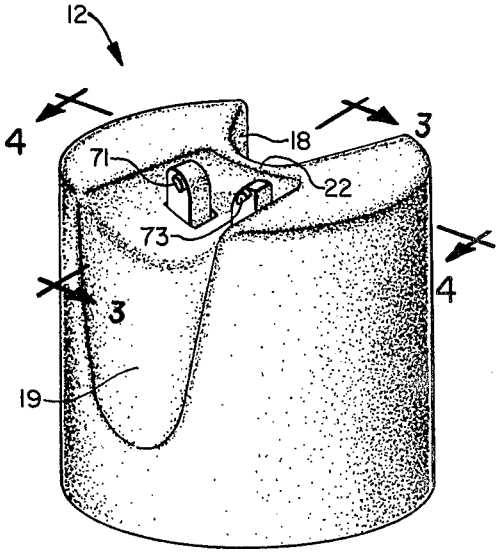
FIG. 2 is a perspective view showing the back portion of the overcap shown in FIG. 1.
Figure 5:
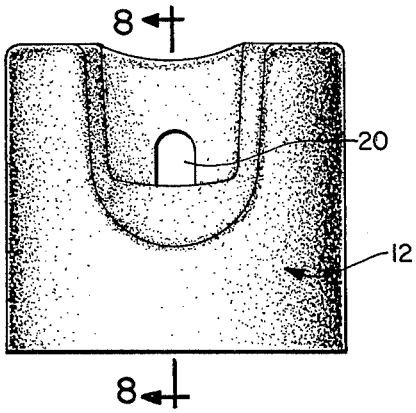
FIG. 5 is a front view of the outer shell shown in FIG. 1.
Figure 6:
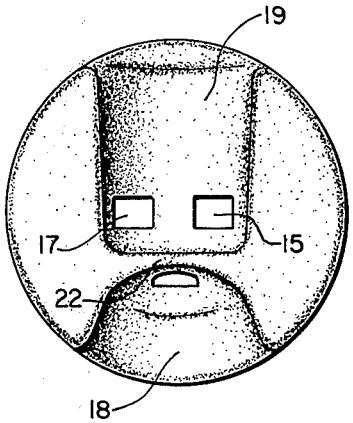
FIG. 6 is a top view of the outer shell shown in FIG. 1.
Figure 8:
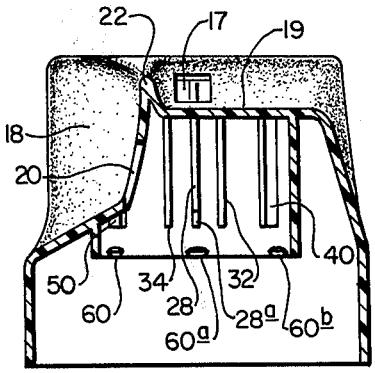
Figure 9:
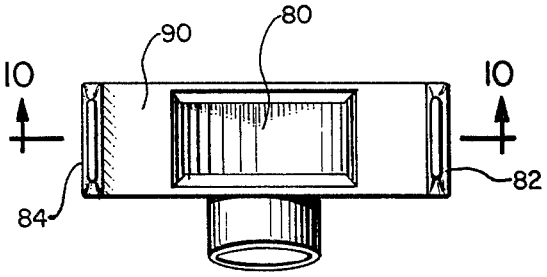
Figure 10:
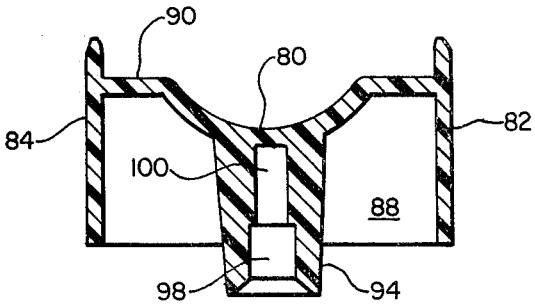
Figure 11:
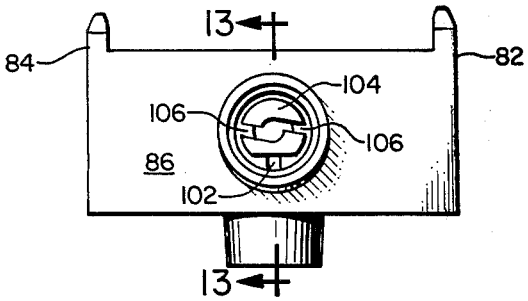
Figure 12:
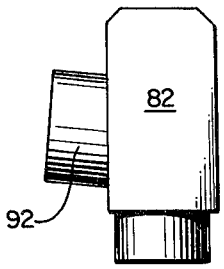
Figure 13:
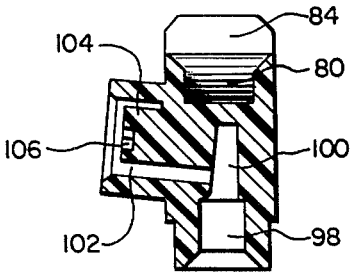
Figure 14:
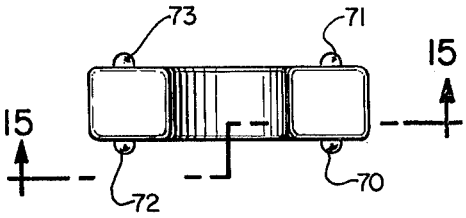
Figure 15:
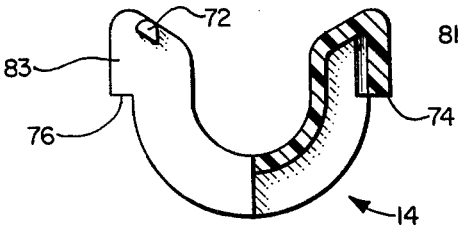
Figure 16:
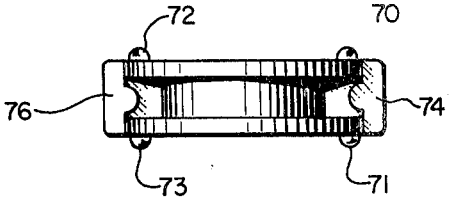

FIG. 8. is a sectional view taken along section lines 8—8 of FIG. 5;

FIG. 9 is a top view of the actuator shown in FIG. 1;

FIG. 10 is a sectional view taken along section lines 10—10 of FIG. 9;

FIG. 11 is a front view of the actuator shown in FIG. 1;

FIG. 12 is a side view of the actuator shown in FIG. 1;

FIG. 13 is a sectional view taken along section lines 13—13 of FIG. 11;

FIG. 14 is a top view of the communicator shown in FIG. 1;

FIG. 15 is a partial, sectional view taken along section lines 15—15 of FIG. 14;

FIG. 16 is a bottom view of the communicator shown in FIG. 1; and

Figure 17:
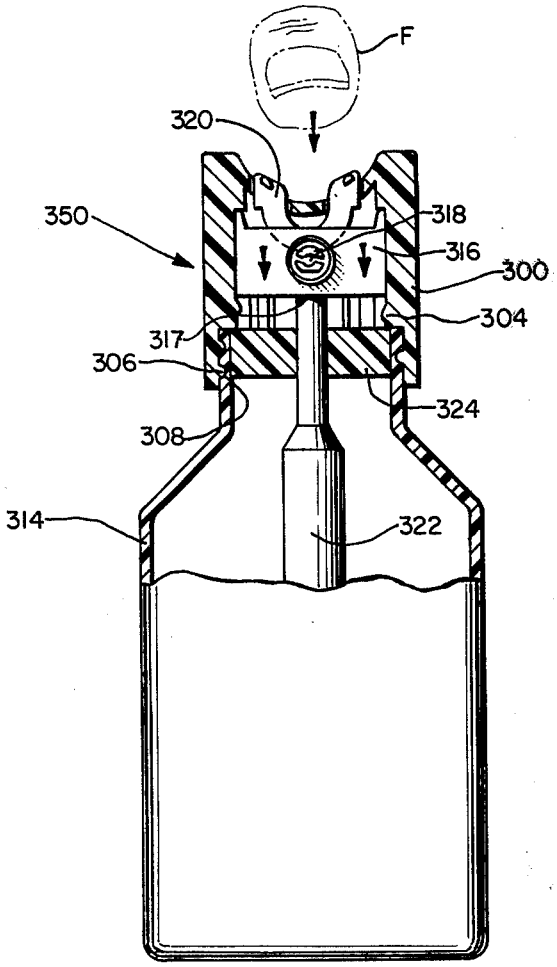

FIG. 17 is a partially broken front elevational view of an overcap of this invention on a spray pump dispensing container.

Referring now to FIG. 1–8, it can be seen that a safety overcap of this invention for aerosol containers, generally designated by the numeral 10, has an outer shell, generally designated by the numeral 12, a communicator, generally designated by the numeral 14 and an actuator, generally designated by the numeral 16.

The outer shell 12 is cylindrical in shape except for dispensing recess 18 and finger recess 19. Dispensing recess 18 is useful as it removes any interference outer shell 12 may present to the free flow of spray through dispensing window 20. It is to be understood that other shaped dispensing recesses amy be utilized and that the one depicted in the drawing is not meant to limit the cap of this invention in any way. Finger recess 19 serves to comfortably receive the adult finger when dispensing the contents of the container. Finger recess 19 is preferably dimensioned so that its side edges are a distance apart which is only slightly larger than the width of communicator 14. By having this narrow distance additional protection against dispensing by a child is achieved as the distance is narrower than the average width of two fingers of a child. Thus, a child is prevented from using two fingers on the same hand to simultaneouly depress both legs of communicator 14. Preferably, to achieve this added protection, the side edges are from 5/6 to about ⅞ inches apart.

Separating finger recess 19 and dispensing recess 18 is interference wall 22. Interference wall 22 serves to hinder the child from utilizing foreign objects such as sticks, etc. to overcome the safety features of the cap and to dispense the contents of the container. It is to be understood that the depicted shapes for finger recess 19 and interference wall 22 are ones which have been found to be highly comfortable for the user and attractive in appearance and do not in any way preclude the utilization of other configurations which serve the same purpose.

Figure 3:
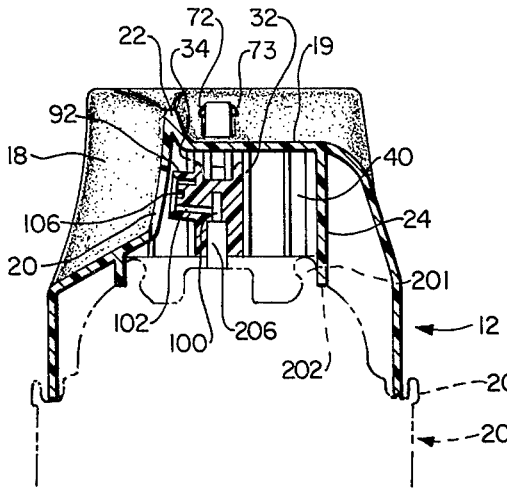
FIG. 3 is a sectional view taken along section lines 3—3 of FIG. 2.
Figure 4:
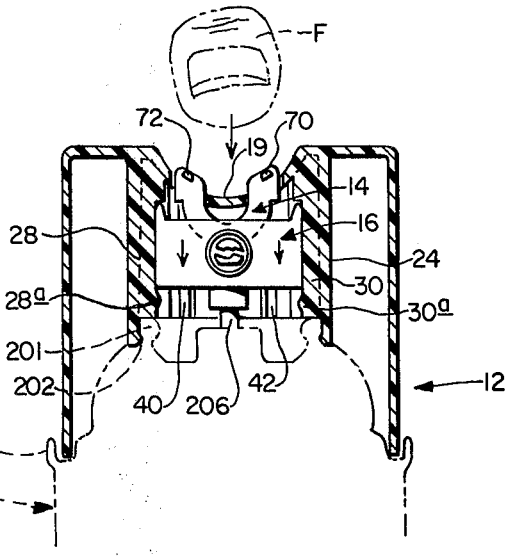
FIG. 4 is a sectional view taken along section lines 4—4 of FIG. 2.
Figure 7:
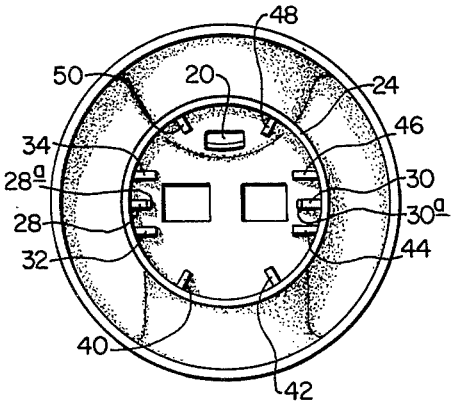
FIG. 7 is a bottom view of the outer shell shown in FIG. 1.

Attached to the top inside wall of outer shell 12 is cylindrical attaching element 24. The coaxial positioning of attaching element 24 with respect to outer shell 12 is shown in FIG. 7. One of the purposes of attaching element 24 is to attach overcap 10 to the aerosol container generally designated by the numeral 200 and shown in FIG. 3 and 4. Attachment is achieved by the utilization of inwardly protruding snapping protuberances which are located around the bottom inside periphery of attaching element 24. Some of these protuberances 60, **60*a* and 60*b* are shown in FIG.8. As is shown in FIG. 4, the protuberances 60*a* and 60*b* snap under undercut 202 of the aerosol container. To aid in rigidifying the attachment achieved by the protuberances, the bottom-most portion of outer shell 12 is dimensioned so as to be received within annular groove 204 shown in FIGS. 3 and 4. Groove 204 is formed by the crimped annular seal for attaching the top to the container. Also provided to assure proper attachment are vertical ribs 50, 34, 28, 32, 40, 42, 44, 30, 46, and 48 which are on the inside surface of attachment element 24. As can be seen in FIGS. 3 and 4, these attaching ribs are so dimensioned in length that they rest upon shoulder 201. As can be appreciated, these ribs prevent any downward movement of cap 10 after the attaching protuberances have achieved a snap fit into undercut 202**.

Ribs 34, 28 and 32, which make up one set, and ribs 46, 30 and 44, which make up the other set, also serve another important function. These two sets of ribs slidably cooperate with the actuator, designated generally by the numeral 16, so as to provide stability for actuator 16 as it moves upward and downward. Ribs 34 and 32 on one side and 46 and 44 on the other side border actuator 16 to prevent any back and forth motion of actuator 16. Ribs 28 and 30, which are narrower than ribs 34, 32, 46 and 44, are to prevent any unwanted left-right motion of actuator 16. As can be clearly seen therefore, these two sets of ribs act together to form a track in which actuator 16 can move providing predictability and fidelity in actuator movement. At the bottom-most portion of ribs 28 and 30 are rib stops **28*a* and 30*a*, respectively. These rib stops act to keep actuator 16 from falling out of overcap 10 during shipment. In assembling actuator 16 into overcap 10 simple pressure will force actuator 16 beyond rib stops 28*a* and 30*a***.

In FIGS. 9–13 there is depicted actuator 16. The actuator has a valve seat recess 98 for seating on aerosol valve stem 206 as shown in FIGS. 3 and 4. Immediately above valve seat recess 98 is chamber 100 which communicates with sprayer orifice 102. As is well known in the art, a fine misting spray is provided by a swirl chamber 106 which is carried by swirl post 104 which is within swirl post housing 92 and carries spray insert 91 (see FIG. 1). Other types of dispensing orifice configurations may, of course, be used. For instance, actuators which dispense a stream rather than a fine mist are suitable for use with the dispenser cap of this invention. Also useable would be actuators which dispense the product in a foam state or in a powder state.

Providing structure on the actuator 16 for cooperation with the ribs utilized for stabilizing and guiding the actuator is a rectangular guidance box formed by sidewalls 84 and 82, front wall 86, rear wall 88 and top wall 90. The spacing of these walls is such that they will slidably fit within ribs 34 and 32 and 46 and 44 and between ribs 28 and 30, as is shown in FIGS. 3 and 4. It should be noted that sidewalls 84 and 82 have a greater height than front wall 86 and back wall 88. This higher height provides ears which limit the height to which actuator 16 can rise within outer shell 12 and aid in seating of actuator 16 onto stem 206 during capping of container 200.

To provide sure seating of communicator 14 in the actuator there is provided arcuate recess 80 in top actuator wall 90 which recess accommodates the rounded bottom portion of communicator 14. Recess 80 is smooth and thus allows easy slippage of the bottom portion of communicator 14 within recess 80 if only one of legs 83 and 81 is depressed.

It is to be understood that the just-described actuator with arcuate recess and guidance and stabilization structure depicts a preferred form of the apparatus of this invention. Other actuators not having arcuate recesses or structure for providing stabilization and guidance may be used with overcap 10 without loss in function or diminishment in child resistance. For example, the actuators may be any one of the many conventional buttons found on present-day aerosol containers. The U-shaped communicator would merely contact the top of the conventional button and communicate any downward force applied on communicator 14 to the button.

As can be seen in FIGS 14–16, communicator 14 is U-shaped having legs 83 and 81. Communicator stops 76 and 74 are provided so as to aid in assembly and molding of the communicator. Communicator stop protuberances 70–73 as shown in FIG. 14 and FIG. 16 are utilized to prevent over rotation of the communicator in use and to hold communicator in outer shell 12 during assembly and shipping. Width of the communicator at its lowermost end is such that it will loosely and slidably fit within arcuate recess 80. The inside distance between communicator legs 83 and 81 is preferably within the range of from about ¼ inch to about ⅜ inch so that the distance will be large in relation to the average width of a child's finger. Also it should be noted that communicator legs 83 and 81 are of a height so that they protrude through outer shell apertures 17 and 15 sufficiently to provide adequate downward travel of actuator 16 before communicator legs 83 and 81 are stopped by protuberances 70–73 making contact with the top of the cap. On the other hand, communicator legs 83 and 81 should not be so high that they project a substantial distance above the upper surface of outer shell 12. Even though this projection above outer shell 12 would not affect the operability of the overcap of this invention, there could possibly be some loss of the child-resistant qualities of the overcap and might increase danger of inadvertant activation of the valve during shipment.

Referring now to FIG. 17, it can be seen that there is depicted another overcap of this invention, generally designated by the numeral 350, adapted for use on spray pump type dispensers. Outer shell 300 is essentially indentical to the outer shell previously described except that it carries inwardly extending helical threads 306 which are adapted to be threaded onto inwardly extending helical recess 308 on the neck of container 314. U-shaped communicator 320 is also identical to the type described for the overcap utilized on aerosol containers. Actuator 316 fits on top of dispenser 317. Annular stop bead 304 is located within outer shell 300 so as to prevent downward overtravel of actuator 316. No special adaptation for actuator 316 is needed for its use on the spray pump type dispenser. It should be noted that actuator 316 carries swirl chamber 318 for providing a mist-like spray. Other forms of spray may be dispensed by altering swirl chamber 318's configuration. Depending downward is dip leg 322 which carries some of the mechanism of the pump for the spray pump type dispenser. Dip leg 322, of course, extends down into the contents of the container to be dispensed. Plug 324 fits within the neck of container 314 and is used to prevent leakage of the contents through the neck.

In operation, the overcap utilized on either the aerosol or spray pump type dispensers is essentially the same. As is shown in FIG. 4 for the aerosol type dispenser and FIG. 17 for the spray pump type dispenser, a finger is placed on both of the legs of communicator 14 and 320 respectively. A downward force is applied to the communicator making sure that both legs are depressed simultaneously which results in the downward movement of the actuator thereby depressing the stem causing release of the contents from the container. When the finger is taken off of the communicator of both types of dispensers, the actuator will return to the "Up" position so that the contents are no further dispensed. Should a child attempt to dispense material without simultaneously depressing both legs of the communicator, no dispensing will occur. Pressure on only one of the legs will merely cause the communicator to rotate on top of the actuator. By requiring pressing of both communicator legs simultaneously there is required a certain amount of mental maturity to determine the axact mode in which dispensing can be effected. The child, not knowing the mode, is unable to figure out that simultaneous depression of both legs is required and thus is unable to dispense the contents from the container.

The actuator of this invention and its component parts can be made of any suitable plastic material such as polypropylene, high density polyethylene, nylon, etc. Conventional injection molding techniques will suffice to produce an overcap having suitable quality and sufficient economy.

What is claimed is:

1. A safety overcap for use on containers which have a dispensing stem extending through the top of the container, which overcap comprises:

a. actuator means attached to the stem;

b. an outer shell enclosing said actuator and attached to said container by attaching means, said outer shell having i. a dispensing window via which said product leaves the enclosed area of said outer shell and ii. a pair of spaced apart apertures positioned in the proximity of said actuator; and c. a U-shaped communicator having its bottom portion slidably contacting said actuator and having the upper portion of its legs extending through said apertures.

2. The overcap of claim 1 wherein said outer shell is cylindrical in shape.

3. The overcap of claim 2 wherein said overcap is cylindrical in shape and said attaching means is concentrically carried by said overcap.

4. The overcap of claim 1 wherein said overcap additionally has guidance means for guiding said actuator as it moves in an upward and downward direction.

5. The overcap of claim 4 wherein said guidance means comprises two sets of two oppositely opposed, downwardly extending ribs and wherein said actuator has a front wall, a back wall and two paralled sidewalls, said front wall and back wall being slidably held between said two ribs of each set whereby unwanted frontward and backward motion of said actuator is prevented.

6. The overcap of claim 1 wherein said actuator has an arcuate recess into which the bottom portion of said U-shaped communicator is slidably seated.

7. The overcap of claim 1 wherein there is provided in said overcap a finger recess in which said apertures are positioned, said recess having a width at a point adjacent said apertures only slightly larger than the distance from the outside of one aperture to the outside of the other aperture.

8. The overcap of claim 7 wherein said width is within the range of from about 5/6 to about ⅞ inches.

9. The overcap of claim 5 wherein said actuator has an arcuate recess into which the bottom portion of said U-shaped communicator is slidably seated.

10. The overcap of claim 9 wherein there is provided in said overcap a finger recess in which said apertures are positioned, said recess having a width at a point adjacent said apertures only slightly larger than the distance from the outside of one aperture to the outside of the other aperture.

11. The overcap of claim 1 wherein said container is an aerosol container which has an undercut shoulder surrounding said stem and wherein said attaching means comprises a hollow cylindrical element being carried by the inside of said outer shell and having on its inside surface inwardly projecting protuberances which protuberances snap under the undercut shoulder to provide a snap fit.

12. The overcap of claim 1 wherein said dispensing stem is the dispensing stem of a hand-operated pump.

13. The overcap of claim 12 wherein said attaching means is a helical thread which cooperates with a helical recess on the outside surface of the neck of said container.

* * * * *